US009291119B2

(12) United States Patent
Hempston

(10) Patent No.: US 9,291,119 B2
(45) Date of Patent: Mar. 22, 2016

(54) PISTON ASSEMBLY WITH PRELOADED SUPPORT SURFACES

(71) Applicant: Martyn Hempston, Talbott, TN (US)

(72) Inventor: Martyn Hempston, Talbott, TN (US)

(73) Assignee: Mahle International GmbH, Stuttgart (DE)

( * ) Notice: Subject to any disclaimer, the term of this patent is extended or adjusted under 35 U.S.C. 154(b) by 275 days.

(21) Appl. No.: 13/828,031

(22) Filed: Mar. 14, 2013

(65) Prior Publication Data

US 2014/0260957 A1 Sep. 18, 2014

(51) Int. Cl.
*F02F 3/00* (2006.01)

(52) U.S. Cl.
CPC ..... *F02F 3/00* (2013.01); *Y10T 29/49249* (2015.01)

(58) Field of Classification Search
CPC ..... F02F 3/22; F02F 3/0015
USPC ..... 92/216, 219, 186
See application file for complete search history.

(56) References Cited

U.S. PATENT DOCUMENTS

| | | | | |
|---|---|---|---|---|
| 3,868,192 | A | 2/1975 | Pennington et al. | |
| 4,548,127 | A | 10/1985 | Dunn et al. | |
| 5,014,599 | A | 5/1991 | Kocsis et al. | |
| 5,052,280 | A | 10/1991 | Kopf et al. | |
| 5,207,061 | A | 5/1993 | Kosarski, Jr. | |
| 5,392,693 | A | 2/1995 | Engel et al. | |
| 5,724,733 | A | 3/1998 | Engel et al. | |
| 5,913,960 | A | 6/1999 | Fletcher-Jones | |
| 6,155,157 | A | 12/2000 | Jarrett | |
| 6,182,630 | B1 | 2/2001 | Zhu et al. | |
| 6,491,013 | B1 | 12/2002 | Gaiser et al. | |
| 6,513,477 | B1 | 2/2003 | Gaiser et al. | |
| 6,622,613 | B1 * | 9/2003 | Kortas et al. | 92/223 |
| 6,729,291 | B1 * | 5/2004 | Scharp et al. | 123/193.6 |
| 7,302,927 | B1 * | 12/2007 | Scharp et al. | 123/193.6 |
| 7,533,601 | B2 * | 5/2009 | Lapp et al. | 92/186 |
| 7,584,694 | B2 * | 9/2009 | Scharp | 92/221 |
| 7,628,135 | B2 * | 12/2009 | Messmer | 123/193.6 |
| 7,934,482 | B2 * | 5/2011 | Messmer | 92/220 |
| 7,946,216 | B2 * | 5/2011 | Scharp et al. | 92/218 |
| 7,946,268 | B2 * | 5/2011 | Messmer | 92/220 |

(Continued)

FOREIGN PATENT DOCUMENTS

| | | | |
|---|---|---|---|
| EP | 1084793 | A1 | 3/2001 |
| EP | 2025441 | A1 | 2/2009 |

(Continued)

OTHER PUBLICATIONS

English Abstract for EP 2025441.

*Primary Examiner* — Thomas E Lazo
(74) *Attorney, Agent, or Firm* — Fishman Stewart PLLC

(57) ABSTRACT

A piston assembly is disclosed which includes a crown and a skirt. The crown and skirt may cooperate to form a cooling gallery. The crown may include an axial support extending away from the combustion bowl, and radially inner and outer support surfaces that are abutted against corresponding radially inner and outer support surfaces of the skirt. The axial support may have a first diameter and a second diameter larger than the first diameter. The skirt may define an aperture receiving the first diameter of the axial support such that the second diameter of the axial support is supported in the skirt on a side of the aperture opposite the crown. The corresponding radially inner and outer support surfaces of the crown and skirt may each be abutted with a radially inner preload, and a radially outer preload, respectively.

19 Claims, 6 Drawing Sheets

(56) References Cited

U.S. PATENT DOCUMENTS

| | | | | |
|---|---|---|---|---|
| 8,113,105 | B2 * | 2/2012 | Issler | 92/220 |
| 8,616,114 | B2 * | 12/2013 | Ribeiro | 92/186 |
| 2002/0124721 | A1 | 9/2002 | Bedwell | |
| 2003/0051694 | A1 | 3/2003 | Gaiser et al. | |
| 2003/0183076 | A1 | 10/2003 | Nakamura et al. | |
| 2012/0192828 | A1 | 8/2012 | Schulz et al. | |

FOREIGN PATENT DOCUMENTS

| | | | |
|---|---|---|---|
| GB | 160790 | A | 12/1921 |
| JP | 63-108936 | A | 5/1988 |
| NL | 31955 | C | 2/1934 |
| WO | WO-2011072656 | A1 | 6/2011 |

* cited by examiner

PISTON ASSEMBLY WITH PRELOADED SUPPORT SURFACES

BACKGROUND

Internal combustion engine manufacturers are constantly seeking to increase power output and fuel efficiency of their products. One approach to generally increasing efficiency and power is to reduce the oscillating mass of an internal combustion engine, e.g., of the pistons, connecting rods, and other moving parts of the engine. Engine power may also be increased by raising the compression ratio of the engine. Raising the compression ratio of an engine also generally raises the pressure and temperature within the combustion chamber during operation.

As a result of the weight reductions in combination with increased pressures and temperatures associated with operation, engines, and in particular the pistons of the engine, are under increased stress. Piston cooling is therefore increasingly important for withstanding the increased stress of such operational conditions over the life of the engine.

To reduce the operating temperatures of piston components, a cooling gallery may be provided about a perimeter of the piston. A coolant such as crankcase oil may be introduced to the cooling gallery, and may be distributed about the cooling gallery by the reciprocating motion of the piston, thereby reducing the operating temperature of the piston.

At the same time, the cooling galleries may increase overall complexity of the piston assembly and manufacturing of the same. For example, cooling galleries may require additional component, such as a cooling gallery cover, to encourage proper circulation of a coolant throughout the cooling gallery by temporarily retaining coolant (e.g., oil) that is circulated through the cooling gallery. The additional components such as cover plates also add complexity, however. Additionally, cooling galleries may be expensive and/or difficult to form in smaller piston applications such as in the case of lightweight or light duty pistons.

Accordingly, there is a need for a piston that is practical for production in a mass manufacturing environment, while also allowing adequate cooling, such as by providing a cooling gallery.

BRIEF DESCRIPTION OF THE DRAWINGS

Referring now to the drawings, illustrative examples are shown in detail. Although the drawings represent the exemplary illustrations described herein, the drawings are not necessarily to scale and certain features may be exaggerated to better illustrate and explain an innovative aspect of an exemplary illustration. Further, the exemplary illustrations described herein are not intended to be exhaustive or otherwise limiting or restricting to the precise form and configuration shown in the drawings and disclosed in the following detailed description. Exemplary illustrations of the present invention are described in detail by referring to the drawings as follows.

DETAILED DESCRIPTION

Figure 1:
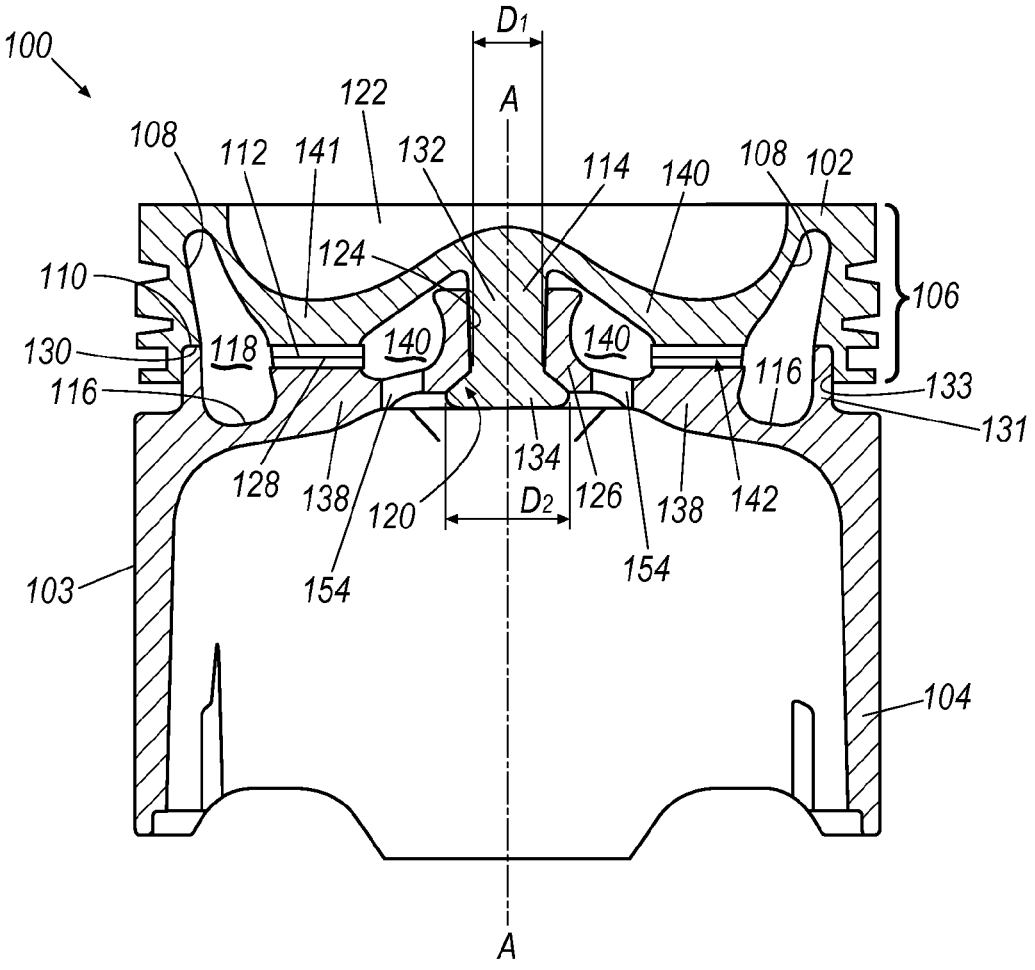
FIG. 1 is a section view of an exemplary piston assembly.

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Various exemplary illustrations are provided herein of a piston assembly including a crown and a skirt. An exemplary crown may have an upper combustion bowl surface and a ring belt portion disposed about the combustion bowl, as well as an upper cooling gallery surface. The crown may further include a radially outer crown support surface, a radially inner crown support surface, and an axial support extending away from the combustion bowl. The radially inner and outer crown support surfaces may be spaced radially away from the axial support. The axial support may have a first diameter and a second diameter larger than the first diameter. The skirt may define a lower cooling gallery surface cooperating with the upper cooling gallery surface to define at least in part a cooling gallery extending about a perimeter of the piston. The skirt may further define an aperture receiving the first diameter of the axial support such that the second diameter of the axial support is supported in the skirt on a side of the aperture opposite the crown. The skirt may further define radially inner and outer skirt support surfaces which are abutted against the corresponding radially inner and outer crown support surfaces with a radially inner preload, and a radially outer preload, respectively.

Exemplary methods may include providing a crown having an upper combustion bowl surface and a ring belt portion disposed about the combustion bowl. The crown may define an upper cooling gallery surface, a radially outer crown support surface, and a radially inner crown support surface. The crown may further include an axial support extending away from the combustion bowl, where the axial support has a first diameter and a second diameter larger than the first diameter. Exemplary methods may further include inserting the first diameter of the axial support into an aperture of a skirt such that the second diameter of the axial support is supported in the skirt on a side of the aperture opposite the crown. The skirt may define a lower cooling gallery surface cooperating with the upper cooling gallery surface to define at least in part a cooling gallery extending about a perimeter of the piston. The skirt may also further define radially inner and outer skirt support surfaces. An exemplary method may further include abutting the radially inner skirt support surface against the radially inner crown support surface to define a radially inner preload, and abutting the radially outer skirt support surface against the radially outer crown support surface to define a radially outer preload.

Turning now to FIG. 1, an exemplary piston assembly 100 is illustrated. Piston assembly 100 may include a crown 102 and a skirt 104. The crown 102 may define an upper combustion bowl surface 122 and a ring belt portion 106 disposed about the combustion bowl 122. The crown 102 may also define an upper cooling gallery surface 108. The skirt 104 may in turn define a lower cooling gallery surface 116 that cooperates with the upper cooling gallery surface 108 to define at least in part a cooling gallery 118 extending about a perimeter of the piston 100. The cooling gallery 118 generally extends about a perimeter of the piston crown 102, and may circulate a coolant during operation, e.g., engine oil, thereby reducing an operating temperature of the piston. Additionally, the circulation of the coolant may facilitate the maintaining of a more stable or uniform temperature about the piston 100, and especially in the upper portion of the piston assembly 100, e.g., adjacent the combustion bowl 122.

Additionally, the cooperation of the crown 102 and skirt 104 in defining the cooling gallery 118, as well as other features of the piston 100 described below, may generally allow flexibility in regard to the size and shape of the piston 100 and components thereof, e.g., crown 102 and skirt 104. Merely as one example, a lower overall compression height and/or center of gravity of the piston assembly 100 may be achieved as a result of the generally two-piece construction of the piston 100. Moreover, the exemplary methods described below may facilitate the use of similar or different materials in forming the crown 102 and skirt 104, as will be described further below.

The piston body 102 may include a skirt surface 103 that generally supports the piston assembly 100 during engine operation, e.g., by interfacing with surfaces of an engine bore (not shown) to stabilize the piston assembly 100 during reciprocal motion within the bore. For example, the skirt surface 103 may generally define a circular outer shape about at least a portion of a perimeter of the piston assembly 100. The outer shape may correspond to the engine bore surfaces, which may be generally cylindrical. The skirt 104 may also define piston pin bosses (not shown) configured to receive a piston pin (not shown) for connecting the piston 100 to a connecting rod (not shown).

A secondary gallery 140 may be defined between the crown 102 and the skirt 104. As will be described further below, a radially inner wall 141 of the crown 102 may cooperate with a radially inner wall 138 of the skirt 104 to form a radially inner boundary of the cooling gallery 118. The walls 138, 141 thereby generally enclose the secondary gallery 140. Nevertheless, one or more apertures or passages 142 may be provided to allow fluid communication between the cooling gallery 118 and the secondary gallery 140. Moreover, as will also be described further below, the secondary gallery 140 may allow fluid communication with an area beneath the piston 100 by way of additional cooling apertures 154 which generally allow fluid to drain out of the secondary gallery 140. Accordingly, a coolant, e.g., engine oil, may be generally circulated through the cooling gallery 118 and the secondary gallery 140 to provide cooling to the piston 100, and in particular, adjacent to combustion bowl 122.

The crown and skirt may be joined to one another via an axial support 114 defined by the crown 102. More specifically, the skirt 104 may define aperture 120 which generally receives the axial support 114 therein. The aperture 120 may be defined by a generally cylindrical inner surface 124 which is defined by a central portion 126 of the skirt 104. The axial support 114 may comprise a stem portion 132 and an end portion 134. The stem portion 132 is generally connected to the crown 102, i.e., directly beneath the combustion bowl 122. By fixedly joining the crown 102 and skirt 104, the piston assembly 100 is generally formed as a one-piece or "monobloc" assembly. Accordingly, the crown 102 may be generally unitized with the skirt 104, such that each is immovable relative to the other after securement to the crown, although the crown 102 and skirt 104 are separate components.

The end portion 134 of the axial support 114 may be generally enlarged with respect to the stem portion 132, thereby securing the crown 102 to the skirt 104, as will be described further below. For example, the end portion 134 of the axial support 114 may define a diameter $D_2$ which is enlarged with respect to a diameter $D_1$ of the stem portion 132. As will be described further below, the end portion 134 may generally be deformed, e.g., in a swaging operation, thereby allowing insertion of the axial support 114 into the aperture 120 and subsequent joining of the crown 102 to the skirt 104.

The crown 102 and skirt 104 may define support surfaces spaced radially away from the axial support that generally allow abutment of the crown 102 and skirt 104. Moreover, as discussed in detail below the support surfaces may be generally preloaded against one another, thereby maintaining the crown 102 and skirt 104 in a preloaded abutment against one another, resulting from the generally permanent joining of the crown 102 and skirt 104. For example, the crown may define a radially outer crown support surface 110 positioned along a radially outward portion of the piston 100 adjacent the ring belt portion 106, and a radially inner crown support surface 112 positioned radially in between the axial support 114 and the radially outer support surface 110. The annular crown support surfaces 110, 112 may be abutted against corresponding skirt support surfaces 128, 130 positioned directly below the crown support surfaces 110, 112 with a preload or force. Moreover, the radially inner support surfaces 112, 128 may be abutted against one another with a first preload while the radially outer support surfaces 110, 130 may be abutted against one another with a second preload. In some exemplary approaches, a preload between the radially inner support surfaces 112, 128 may be different than a preload between the radially outer support surfaces 110, 130. In other examples, preloads may generally be balanced between the radially inner and outer support surfaces, such that the magnitude of a preload between each corresponding pair of support surfaces is substantially equal. As will be described further below, a preload associated with the radially inner and outer support surfaces of the crown and skirt may be determined in part by a process used to deform the axial support 114 and bring the crown 102 and skirt 104 into a generally permanent engagement.

To further promote the radial alignment of the crown 102 and skirt 104, outer support surfaces 110, 130 are shown in the form of a mating protrusion received in a receptacle in the form of complementary groove. While surface 130 is shown on a protrusion 131 extending axially upwardly from the skirt 104 into a groove 133 formed within crown 102, the elements may be reversed in some exemplary approaches.

Moreover, while combustion bowl 122 is shown as being generally symmetrical, in some situations the bowl may not be symmetrical. In such a situation we need to consider its radial orientation with respect to a pin bore axis in skirt 104. A refinement of protrusion 131 and groove 133 may be facilitated with aligned small holes between the underside of the crown 102 and skirt 104 adjoined with a dowel pin. The dowel pin acts as the protrusion extending from one hole and the opposing small hole acts as the receptacle for receiving the dowel pin.

Figure 2A:
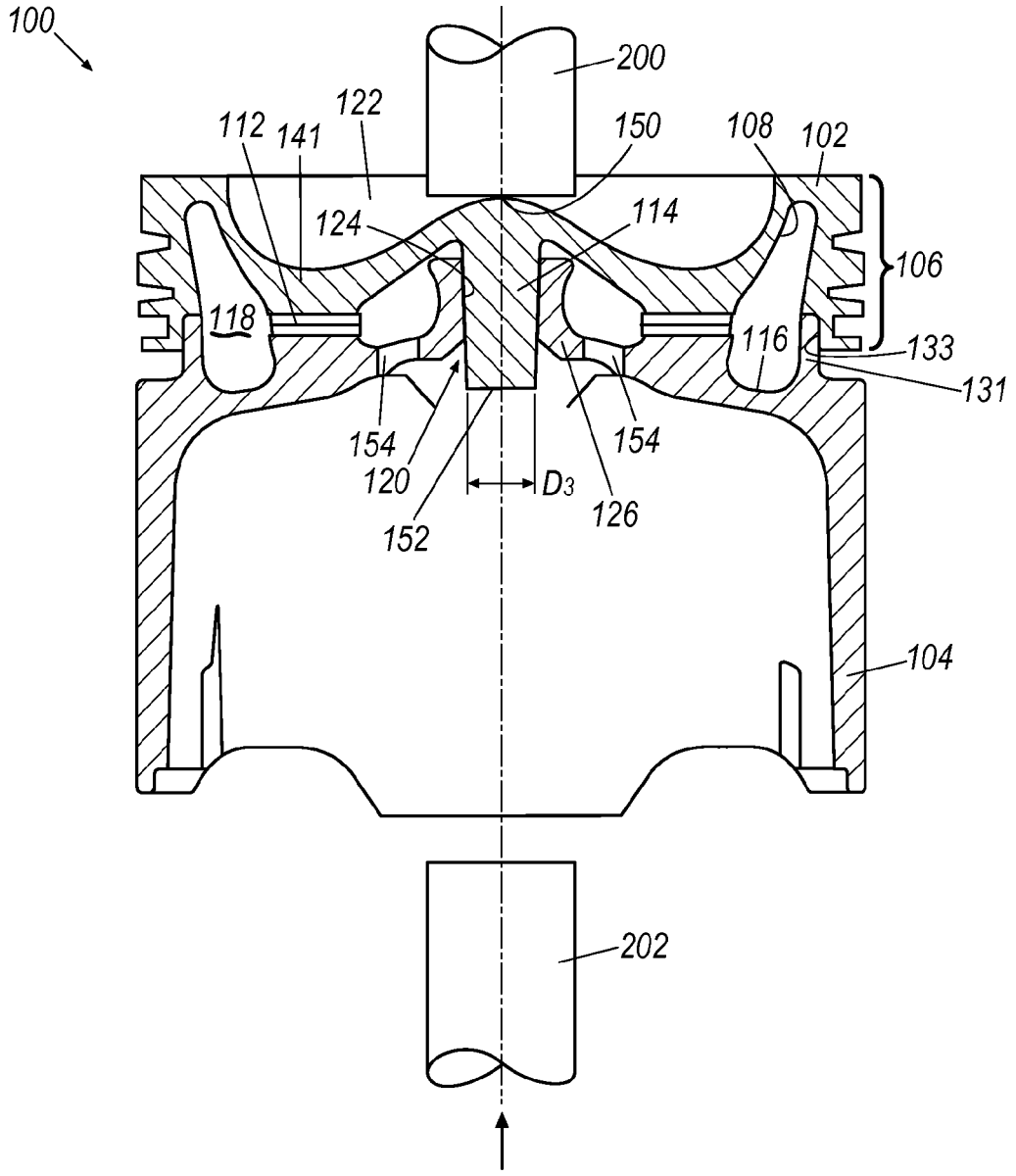
FIG. 2A is a section view of an initial assembly used to make the exemplary piston assembly of FIG. 1.
Figure 2B:
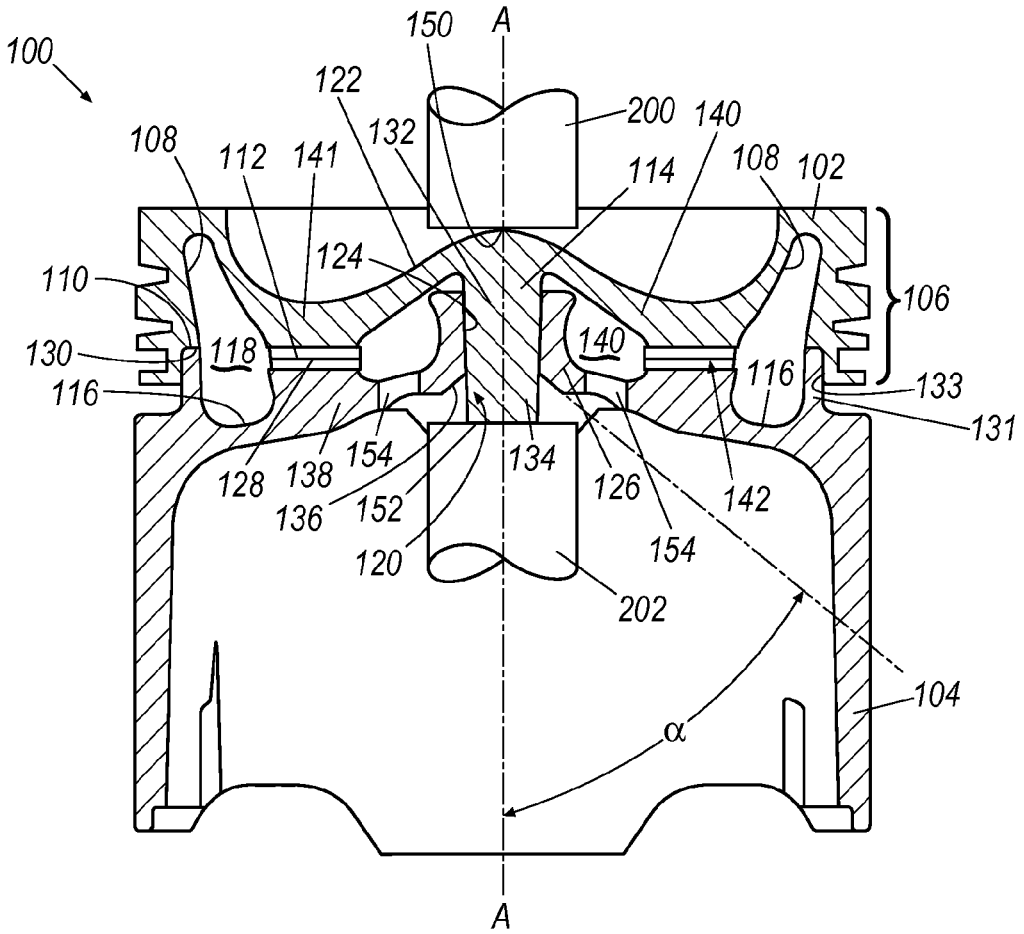
FIG. 2B is a section view of the initial assembly of FIG. 2B at the onset of an exemplary swaging process.
Figure 2C:
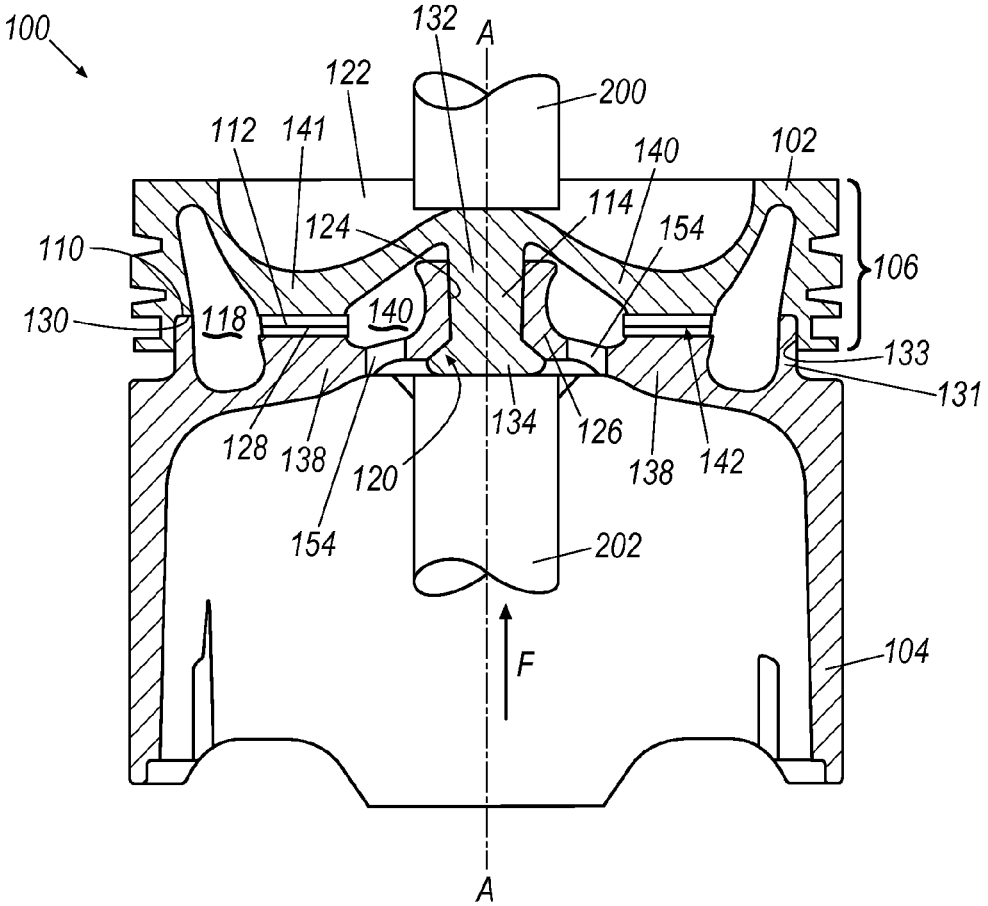
FIG. 2C is a section view of the initial assembly of FIGS. 2A and 2B during an exemplary swaging process.
Figure 2D:
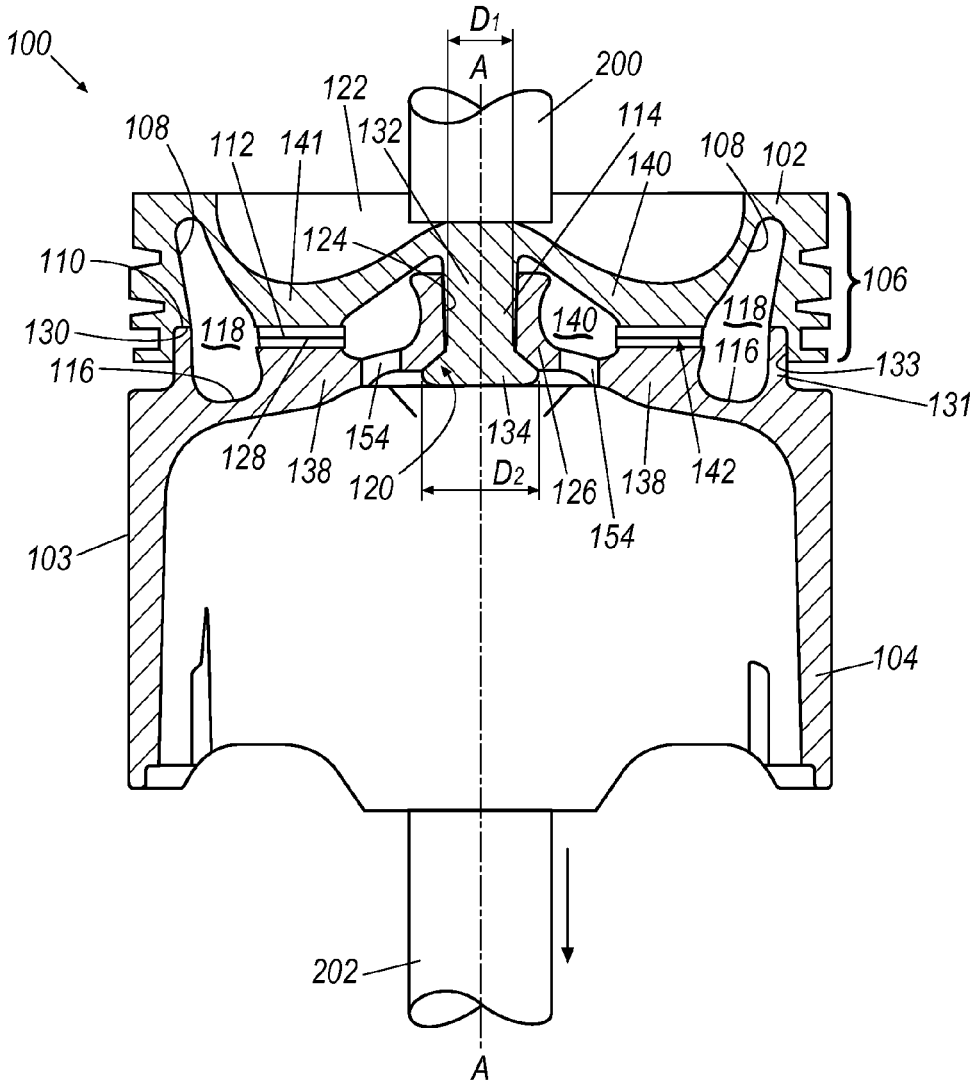
FIG. 2D is a section view of the initial assembly of FIGS. 2A, 2B, and 2C after an exemplary swaging process, resulting in the piston assembly illustrated in FIG. 1.

Turning now to FIGS. 2A through 2D, piston assembly 100 is illustrated in further detail in regard to an exemplary process for joining crown 102 and skirt 104. The axial support 114 may initially define a diameter $D_3$ that generally allows insertion of the axial support 114 into the aperture 120. Subsequently, a pair of electrodes 200, 202 may be brought into contact with an upper portion 150 of the combustion bowl 122 and a bottom face 152 of the axial support 114, as best seen in FIGS. 2A and 2B. The electrodes 200, 202 may deform the axial support 114 in any process that is convenient. Merely as an example, the electrodes 200, 202 may heat the axial support 114 and subsequently deform the axial support 114, as best seen in FIG. 2C. A deformation of the axial support 114 may generally force the end portion 134 of the axial support 14 to be deformed against the annular surface 136 defined by the central portion 126 of the skirt 104, as best seen in FIGS. 2B and 2C. The annular surface 136, as best seen in FIG. 2B, may generally define an oblique angle α with respect to a longitudinal axis A-A of the piston 100. Accordingly, the end portion 134 of the axial support 114 eventually defines a shape corresponding to the annular surface 136, as best seen in FIG. 2C. The presence of annular surface 136 in combination with the mating deformation of end portion 134 facilitates the application of compressive force both axially and radially between the crown 102 and skirt 104, thereby providing a significant and permanent locking between the two components such that they are rigidly fixed against all further movement. While the presence of the annular surface 236 provides additional surface area to facilitate the application of compressive force, the selection of the oblique angle α permits the optimization of the available compressive force between an axial force vector along axis A-A and a radial force vector perpendicular to axis A-A.

Therefore, the deformation of the axial support 114 may bring the radially inner support surfaces 112 and 128, as well as the radially outer surfaces 110 and 130, into at least abutting contact. This initial contact between the radially inner and outer support surfaces of the crown 102 and skirt 104 may be of a predetermined magnitude that is less than the ultimate preload placed upon the support surfaces 110, 130 and/or 112, 128. Subsequently, the electrodes 200, 202 may be moved away from the combustion bowl 122 and/or axial support 114, and the axial support 114 may generally cool. As the axial support 114 cools, the abutting contact and any preload between support surfaces of the crown 102 and skirt 104 may generally increase, e.g., as a result of contraction of the axial support 114 during the cooling process. In the illustrated example, the axial support and end portion 134 are both solid, maximizing the amount of material available to participate in the providing of compressive force and to take advantage of the resulting contraction relating to the material properties of the axial support and end portion 134.

The exemplary joining processes described above may generally allow any number of material combinations and constructions of the crown 102 and skirt 104. Accordingly, the piston crown 102 and skirt 104 may be constructed from any materials that are convenient. In one exemplary illustration, the crown 102 and skirt 104 are formed of different materials. In another example, the crown 102 and skirt 104 are formed of the same material, e.g., steel. Accordingly, a material used for each of the components may be selected more independently of the other component, facilitating the materials of each to be closely matched with the general requirements and operating conditions relevant to each. Piston crown 102 may, merely as examples, include different mechanical properties, e.g., yield point, tensile strength or hardness, than the skirt 104. Merely as examples, the crown 102 and/or skirt 104 may be formed of a steel material, cast iron, aluminum material, composite, or powdered metal material. The crown 102 and skirt 104 may also be formed in a same forming process type, e.g., forging or casting. Alternatively, the cooling gallery ring 104 and body 102 may be formed in different processes. Any material and/or forming combination may be employed that is convenient.

Figure 3:
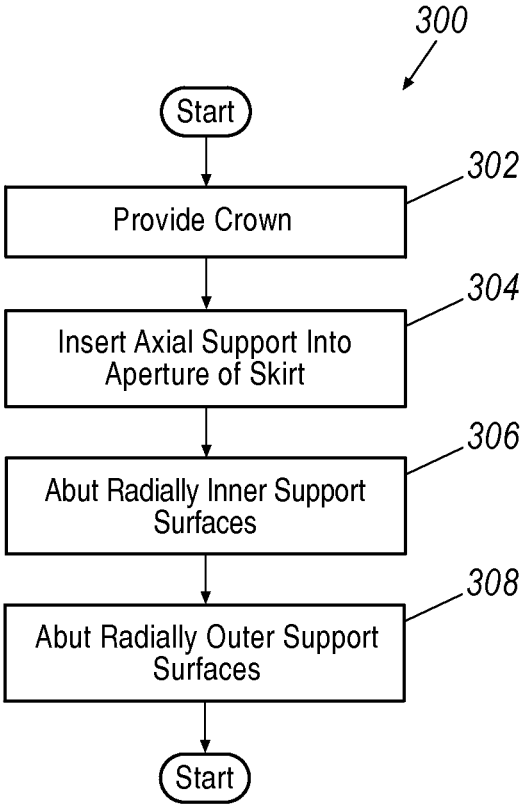
FIG. 3 is a process flow diagram for a method of making piston assembly, according to an exemplary illustration.

Turning now to FIG. 3, an exemplary process 300 for assembling a piston 100 is described in further detail. Process 300 may generally begin at block 302 where the crown is provided. For example, crown 102 may be provided having an upper combustion bowl surface 122 and a ring belt portion 106 disposed about the combustion bowl 122. The crown 102 may define an upper cooling gallery surface 108, the radially outer crown support surface 110, and a really inner crown support surface 112. Moreover, the crown 102 may have an axial support 114 extending away from the combustion bowl 122. The axial support 114 may define a first diameter configured to be inserted into a corresponding aperture of a skirt, as will be described further below. Process 300 may then proceed to block 304.

At block 304, axial support 114 may be inserted into an aperture of a skirt. For example, as described above axial support 114 may have a first diameter $D_1$ that is configured to fit within an aperture 120 of the skirt 104. Additionally, as described above the skirt may define a lower cooling gallery surface 116 which cooperates with the upper cooling gallery surface 108 of the crown 102 to define a cooling gallery 118. The skirt 104 may further define the radially inner and outer skirt support surfaces, e.g., radially inner skirt support surface 128 and radially outer skirt support surface 130. The axial support 114 may include a stem portion 114 extending from the crown 102 defining the first diameter $D_1$. The axial support 114 may further include an end portion 134, which has described above may later be deformed to have a second diameter $D_2$.

Proceeding to block 306, the radially inner support surfaces of the crown and skirt may be abutted. For example, as noted above, the radially inner support surface 112 of the crown may be placed at least in abutting contact with a corresponding radially inner crown support surface 128, e.g., upon insertion of the axial support 114 into the aperture 120. Moreover, as shown at block 308, the radially outer support surfaces of the crown and skirt may be abutted. For example, the radially inner support surface 110 of the crown may be placed at least in abutting contact with a corresponding radially outer crown support surface 130, e.g., upon insertion of the axial support 114 into the aperture 120.

The preloading of the support surfaces of the crown 102 and skirt 104 may be accomplished in any manner that is convenient. For example, as noted above each of the radially inner and outer support surfaces of the crown 102 and skirt 104 may be placed at least into a light or abutting contact initially upon receiving the axial support 114 within the aperture 120. Subsequently, the axial support 114 may be generally deformed, e.g., in a swaging operation, where an end portion 134 of the axial support is generally deformed such that the crown 102 and skirt 104 are secured together. Moreover, while a light or abutting contact may be initially present between the radially inner and outer crown and skirt support surfaces upon insertion of the axial support 114 into the aperture 120, a preloading between one or both pairs of the support surfaces may subsequently increase, e.g., as a result of a cooling or contraction of axial support 114. For example, a heating operation associated with the axial support 114 may generally enlarge the axial support at least in an axial direction, i.e., parallel to the longitudinal axis A-A of the piston 100. As the axial support 114 cools down, contraction of the axial support 114 resulting from the reduction in temperature may increase the preload between one or both pairs of support surfaces of the crown 102 and skirt 104.

As noted above, a preload of the resulting piston 100 along the really inner support surfaces 112, 128 may be generally equal to a preload between radially outer disposed support surfaces 110, 130. In another exemplary illustration, preloads between the radially inner and outer support surfaces may be different. For example, one of the pairs of support surfaces, e.g. the radially outer support surfaces 110 and 130, may upon initial assembly of the crown 102 to the skirt 104 be spaced apart by a small distance, while the radially inner support surfaces 112 and 128 are in light or abutting contact with a given preload. After the deformation of the axial support 114 and subsequent cooling and/or contraction thereof, preloading between the radially inner support surfaces 112, 128 may increase. Moreover, the contraction of the axial support 114 may also bring the radially outer support surfaces 110, 130 into in abutting contact, resulting in a second preload between the radially outer support surfaces 110, 130. Accordingly, the preload along the radially inner support surfaces 112 and 128 may generally be greater than the preload between the radially outer support surfaces 110, 130. In another approach, the axial extent of protrusion 131 into groove 133 may be selected to facilitate axial contact between the two components even before deformation of axial support 114. In such a situation the preload of the outer support surfaces may be greater than that of the radially inner support surfaces. Accordingly, the radially inner and radially outer support surfaces may be configured to have a same or different preload, allowing the interfaces between the pairs of support surfaces to be customized for the particular configuration of each. Merely as another example, the radially inner support surfaces 112, 128 may offer a larger surface area as compared with the radially outer support surfaces 110, 130, and thus may be more capable of maintaining a larger preload. In this manner, the radially inner support surfaces 112, 138 may generally be configured to accept a greater share of the preload between the crown 102 and skirt 104, allowing an overall larger preload between the crown 102 and skirt 104. Accordingly, the crown 102 and skirt 104 may be more securely fastened together. Therefore, combinations of both axial and radial extents of the mating components as well as their relative locations from the origin of the force of compression may be adjusted to provide the desired level of preload.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A method of assembling a piston, comprising:

providing a crown having an upper combustion bowl surface and a ring belt portion disposed about the combustion bowl, the crown defining an upper cooling gallery surface, a radially outer crown support surface, and a radially inner crown support surface, the crown having an axial support extending away from the combustion bowl, the axial support having a first diameter and a second diameter larger than the first diameter, the radially inner and outer crown support surfaces being spaced radially away from the axial support;

inserting the first diameter of the axial support into an aperture of a skirt such that the second diameter of the axial support is supported in the skirt on a side of the aperture opposite the crown, the skirt defining a lower cooling gallery surface cooperating with the upper cooling gallery surface to define at least in part a cooling gallery extending about a perimeter of the piston, the skirt defining radially inner and outer skirt support surfaces;

abutting the radially inner skirt support surface against the radially inner crown support surface to define a radially inner preload;

abutting the radially outer skirt support surface against the radially outer crown support surface to define a radially outer preload; and deforming an end portion of the axial support to facilitate the abuttings.

2. The method of claim 1, wherein the axial support includes a stem portion extending from the crown and defining the first diameter, the axial support including an end portion defining the second diameter.

3. The method of claim 1, further comprising heating the axial support.

4. The method of claim 3, further comprising establishing the radially inner and radially outer preloads from at least a cooling of the axial support after the heating of the axial support.

5. The method of claim 3, further comprising establishing the radially inner and radially outer preloads from at least a contraction of the axial support after the heating of the axial support.

6. The method of claim 1, further comprising adjusting a vector component of preload in an axial direction and adjusting a vector component of preload in a radial direction by way of the aperture including an annular surface defining an oblique angle with respect to a longitudinal axis of the piston.

7. The method of claim 6, further comprising deforming the axial support against the annular surface, the deformation defining in part the radially inner and radially outer preloads.

8. The method of claim 1, further comprising establishing the radially inner and outer preloads as substantially equal.

9. The method of claim 1, wherein the upper and lower cooling gallery surfaces substantially enclose the cooling gallery.

10. A piston assembly, comprising:

a crown having an upper combustion bowl surface and a ring belt portion disposed about the combustion bowl, the crown defining an upper cooling gallery surface, a radially outer crown support surface, and a radially inner crown support surface, the crown having an axial support extending away from the combustion bowl, the axial support having a first diameter and a second diameter larger than the first diameter, the radially inner and outer crown support surfaces spaced radially away from the axial support; and a skirt defining a lower cooling gallery surface cooperating with the upper cooling gallery surface to define at least in part a cooling gallery extending about a perimeter of the piston, the skirt defining an aperture receiving the first diameter of the axial support such that the second diameter of the axial support is supported in the skirt on a side of the aperture opposite the crown;

wherein the skirt defines radially inner and outer skirt support surfaces, the radially inner skirt support surface abutted against the radially inner crown support surface with a radially inner preload, and the radially outer skirt support surface is abutted against the radially outer crown support surface with a radially outer preload;

wherein an end portion of the axial support is deformed, thereby facilitating the abuttings.

11. The piston assembly of claim 10, wherein the axial support includes a stem portion extending from the crown and defining the first diameter, the axial support including the end portion, the end portion defining the second diameter.

12. The piston assembly of claim 10, wherein the aperture is defined by an annular surface defining an oblique angle with respect to a longitudinal axis of the piston.

13. The piston assembly of claim 10, wherein the radially inner and outer preloads are substantially equal.

14. The piston assembly of claim 10, wherein the radially inner support surfaces define a radially inner boundary of the cooling gallery.

15. The piston assembly of claim 14, further comprising a secondary gallery disposed radially inwardly of the cooling gallery.

16. The piston assembly of claim 15, wherein the secondary gallery includes at least one passage extending through radially inner walls of the crown and skirt, the radially inner walls defining the radially inner crown support surface and the radially inner skirt support surface, respectively.

17. The piston assembly of claim 10, wherein the upper and lower cooling gallery surfaces substantially enclose the cooling gallery.

18. A method of assembling a piston, comprising:

providing a crown having an upper combustion bowl surface and a ring belt portion disposed about the combustion bowl, a radially outer crown support surface, and a radially inner crown support surface, the crown having an axial support extending away from the combustion bowl, the radially inner and outer crown support surfaces being spaced radially away from the axial support;

inserting the axial support into an aperture of a skirt the aperture including an annular surface defining an oblique angle with respect to a longitudinal axis of the piston, the skirt defining radially inner and outer skirt support surfaces;

deforming an end portion of the axial support to apply a compressive force between the crown and the skirt, thereby abutting the radially inner skirt support surface against the radially inner crown support surface to define a radially inner preload and abutting the radially outer skirt support surface against the radially outer crown support surface to define a radially outer preload; and adjusting a vector component of preload in an axial direction and adjusting a vector component of preload in a radial direction by way of a selection of a value of the oblique angle.

19. The method of claim 18, the outer support surfaces including an axial protrusion received within a receptacle and facilitating both an axial preload and a radial preload.

* * * * *